US011401749B2

(12) United States Patent
Cheng et al.

(10) Patent No.: US 11,401,749 B2
(45) Date of Patent: Aug. 2, 2022

(54) CUTTING ELEMENT WITH REDUCED FRICTION

(71) Applicants: CNPC USA CORPORATION, Houston, TX (US); Beijing Huamei Inc., Beijing (CN)

(72) Inventors: Chris Cheng, Houston, TX (US); Jiaqing Yu, Houston, TX (US); Jianhua Guo, Beijing (CN); Jie Li, Beijing (CN); Xihui Hu, Beijing (CN); Yonghong Wang, Beijing (CN)

(73) Assignees: CNPC USA CORPORATION, Houston, TX (US); Beijing Huamei Inc., Beijing (CN)

( * ) Notice: Subject to any disclaimer, the term of this patent is extended or adjusted under 35 U.S.C. 154(b) by 3 days.

(21) Appl. No.: 16/917,449

(22) Filed: Jun. 30, 2020

(65) Prior Publication Data

US 2021/0002961 A1 Jan. 7, 2021

Related U.S. Application Data

(60) Provisional application No. 62/869,194, filed on Jul. 1, 2019.

(51) Int. Cl.

| | |
|---|---|
| ***E21B 10/567*** | (2006.01) |
| ***E21B 10/55*** | (2006.01) |
| *E21B 10/42* | (2006.01) |

(52) U.S. Cl.
CPC ..... *E21B 10/5673* (2013.01); *E21B 10/55* (2013.01); *E21B 10/42* (2013.01)

(58) Field of Classification Search
CPC ..... E21B 10/55; E21B 10/5673
See application file for complete search history.

(56) References Cited

U.S. PATENT DOCUMENTS

| | | | | |
|---|---|---|---|---|
| 4,224,380 | A | 9/1980 | Bovenkerk et al. | |
| 4,478,297 | A | 10/1984 | Radtke | |
| 4,629,373 | A * | 12/1986 | Hall | B23B 27/146 175/434 |
| 5,054,246 | A * | 10/1991 | Phaal | B24D 99/00 451/540 |
| 5,960,896 | A * | 10/1999 | Barr | E21B 10/43 175/431 |
| 8,157,029 | B2 | 4/2012 | Zhang et al. | |
| 10,022,840 | B1 * | 7/2018 | Miess | B24D 99/005 |
| 10,399,206 | B1 * | 9/2019 | Mortensen | B24D 3/007 |

* cited by examiner

*Primary Examiner* — Blake Michener
(74) *Attorney, Agent, or Firm* — Ramey LLP; William P. Ramey; Jacob B. Henry

(57) ABSTRACT

A cutting element comprises a cylindrical substrate, a table bonded to the substrate, a working surface on the top of the table, and a plurality of dimples on the working surface. The table is made of super-abrasive material. The super-abrasive material can be PCD. Surface patterns of the table can reduce contact friction between the rock and the cutting element. Therefore, heat on the table can be reduced and thermal damage to the table is decreased. This results in improved cutting element service life.

16 Claims, 12 Drawing Sheets

CUTTING ELEMENT WITH REDUCED FRICTION

CROSS-REFERENCE TO RELATED APPLICATIONS

This application claims the benefit to U.S. provisional Application No. 62/869,194 filed on Jul. 1, 2019, the contents of which are incorporated by reference in its entirety.

FIELD

The disclosure relates generally to cutting elements and drill bits. The disclosure relates specifically to cutting elements in the field of drill bits used in petroleum exploration and drilling operation.

BACKGROUND

In drilling a borehole for the recovery of hydrocarbons or for other applications, it is conventional practice to connect a drill bit on the lower end of an assembly of drill pipe sections that are connected end-to-end so as to form a drill string. The bit is rotated by rotating the drill string at the surface and engages the earthen formation, thereby causing the bit to cut through the formation material by either abrasion, fracturing, or shearing action to form a borehole along a predetermined path toward a target zone. Many different types of drill bits have been developed and found useful in drilling such boreholes.

The cutting elements disposed on the blades of a drill bit are typically formed of extremely hard materials. In a typical drill bit, each cutting element includes an elongate and generally cylindrical tungsten carbide substrate that is received and secured in a pocked formed in the surface of one of the blades. A conventional cutting element typically include a hard-cutting layer of polycrystalline diamond ("PCD") or other super-abrasive materials such as thermally stable diamond or polycrystalline cubic boron nitride.

A factor in determining the longevity of PCD cutters is the exposure of the cutter to heat. Polycrystalline diamond may be stable at temperatures of up to 700-750° C. in air, above which observed increases in temperature may result in damage to and structural failure of polycrystalline diamond. This deterioration in polycrystalline diamond may be due to the substantial difference in the coefficient of thermal expansion of the binder material, cobalt, as compared to diamond. Upon heating of polycrystalline diamond, the cobalt and the diamond lattice will expand at different rates, which can cause cracks to form in the diamond lattice structure and result in deterioration of the polycrystalline diamond. Damage may also be due to graphite formation at diamond-diamond necks leading to loss of microstructural integrity and strength loss at extremely high temperatures.

The generation of heat at the cutter contact point, specifically at the exposed part of the PCD layer caused by friction between the PCD and the work material, can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond into graphite, causing rapid abrasive wear. As a cutting element contacts the formation, a wear flat develops and frictional heat is induced. As the cutting element continues to be used, the wear flat will increase in size and further induce frictional heat. The heat may build-up and cause failure of the cutting element due to thermal mismatch between the diamond and catalyst discussed above. This is particularly true for cutters that are immovably attached to the drill bit, as is conventional in the art.

To prolong service life of the PCD cutting elements, in U.S. Pat. No. 4,478,297, Radtke discloses a drill bit having PCD cutting elements mounted on inserts. Said inserts each having a longitudinal recess therein filled with a soft, heat conducting metal operable to facilitate the transfer of heat away from said cutting elements. In U.S. Pat. No. 8,157,029, Zhang et al. disclose a cutting element having thermally stable polycrystalline diamond. To reduce thermal degradation, thermally stable PCD components have been produced. A typical configuration is described in U.S. Pat. No. 4,224,380, the disclosure of which is hereby incorporated by reference. In this type of thermally stable PCD cutter, the cobalt is leached from the interstices. While this increases the temperature resistance of the diamond to about 1200° C., the leaching process also removes the cemented carbide substrate. Because there is no integral substrate or other bondable surface, there are severe difficulties in mounting such material for use in operation. PCD cutters with a thermally stable layer have exceeded the performance of conventional PCD cutters. They have expanded the application of PCD bits into harder and more abrasive formations. However, they have not been successful in high compressive strength highly abrasive applications. In these applications, the PCD cutters continue to wear at a high rate, rendering the drill bit uneconomical for use.

It is therefore desired that a PCD cutting element be developed that provides improved thermal properties when compared to conventional PCD cutting elements in a manner that reduces friction, thereby providing improved cutting element service life. It is further desired that such PCD cutting element has the advantages of simple device, easy fabrication and low cost.

SUMMARY

An embodiment of the present disclosure is a cutting element with a surface pattern that reduces contact friction between the cuttings and the tool surface. The surface pattern can be varied shapes, sizes, and depth.

In a disclosed embodiment, the cutting element comprises a cylindrical substrate, a table bonded to the substrate, a working surface on the top of the table, and a plurality of dimples on the working surface.

In some embodiments, the shapes of the dimples are hemispherical, elliptical, square or rectangle. The distribution of the dimples can be regular or be random. In an embodiment, the dimples can be distributed evenly throughout the working surface or distributed in radial type.

In some embodiments, the table has a working surface and at least one lateral surface, and a chamfer formed therebetween. In an embodiment, the working surface is non-planar. In an embodiment, the working surface is planar. In an embodiment, the angle between the lateral surface and the chamfer is between 30 and 60 degrees. In an embodiment, the angle between the lateral surface and the chamfer is about 45 degrees.

In some embodiments, the table is made of super-abrasive material. In an embodiment, the super-abrasive material can be PCD.

An embodiment of the disclosure is a cutting element comprising a cylindrical substrate; a table bonded to the substrate; a working surface on the top of the table; and a plurality of dimples on the working surface. In an embodiment, the working surface is planar. In an embodiment, the working surface is non-planar. In an embodiment, the shape of the plurality of dimples is hemispherical. In an embodiment, the shape of the plurality of dimples is elliptical. In an embodiment, the shape of the plurality of dimples is square or rectangle. In an embodiment, distribution of the plurality of dimples on the working surface is regular. In an embodiment, distribution of the plurality of dimples on the working surface is random. In an embodiment, the plurality of dimples distribute evenly throughout the working surface. In an embodiment, the plurality of dimples distribute in a radial manner throughout the working surface. In an embodiment, the cutting element further comprises a lateral surface and a chamfer formed between the lateral surface and the working surface. In an embodiment, an angle between the lateral surface and the chamfer is between 30 and 60 degrees. In an embodiment, an angle between the lateral surface and the chamfer is 45 degrees. In an embodiment, the table is made of super-abrasive material. In an embodiment, the super-abrasive material is polycrystalline diamond.

In some preferred embodiments, the cutting element comprises at least one tiny dimple on the surface of at least one of the plurality of dimples. In some other preferred embodiments, the cutting element comprises at least one channel inter-connecting adjacent dimples.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1:
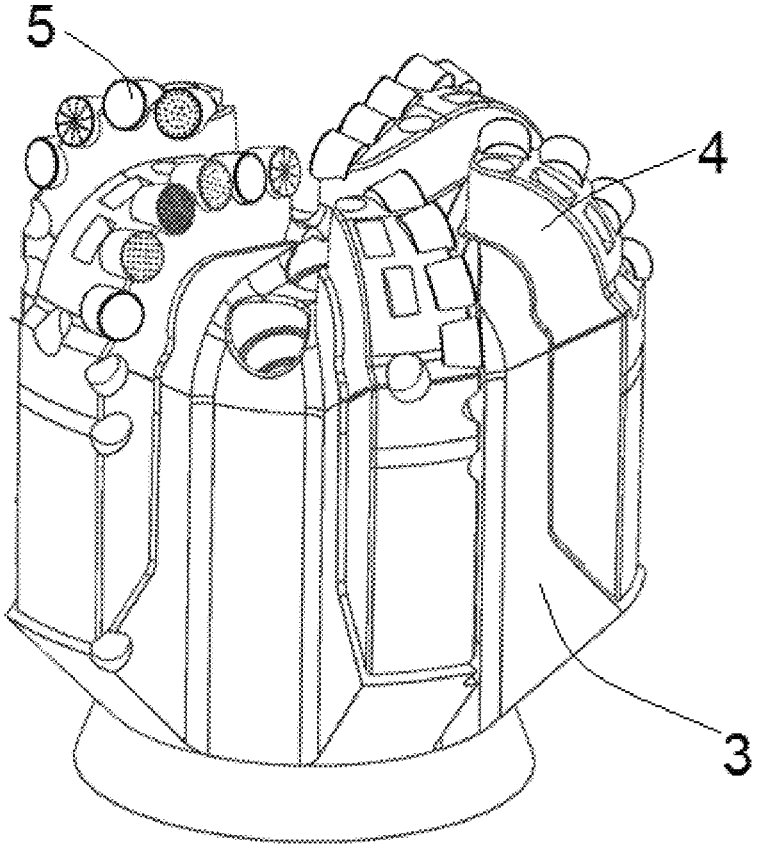
FIG. 1 is a perspective view of the arrangement of a drill bit.
Figure 2:
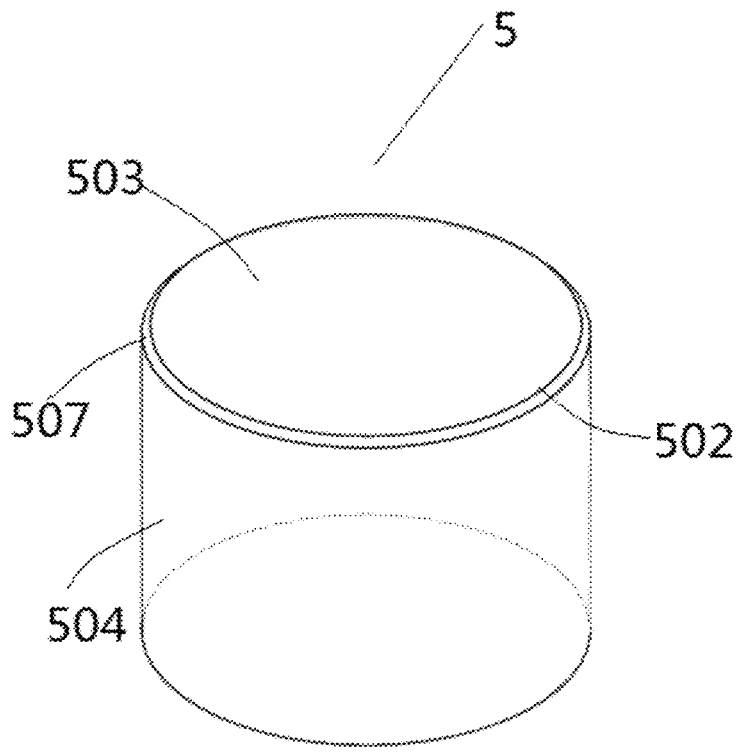
FIG. 2 is a perspective view of the arrangement of a conventional cutting element.

Referring to FIG. 1, a drill bit comprises a drill bit body 3 and a plurality of blades 4, the blades project radially outward from the bit body 3 and form flow channels therebetween. Cutting elements 5 are grouped and mounted on the blades 4 in radially extending rows. The configuration or layout of the cutting elements 5 on the blades 4 may vary widely, depending on a variety of factors, such as the formation to be drilled. Referring to FIG. 2, an example cutting element 5 includes a PCD table 502 and a cemented carbide substrate 504. The PCD table 502 includes an upper exterior working surface 503 and may include an optional chamfer 507 formed between the working surface 503 and the substrate 504. It is noted that at least a portion of the chamfer 507 may also function as a working surface that contacts a subterranean formation during drilling operations. Flat top cutting elements as shown in FIG. 2 are generally the most common and convenient to manufacture with an ultra-hard layer according to known techniques. In an embodiment, the working surface is non-planar. In an embodiment, the working surface is planar.

Figure 3:
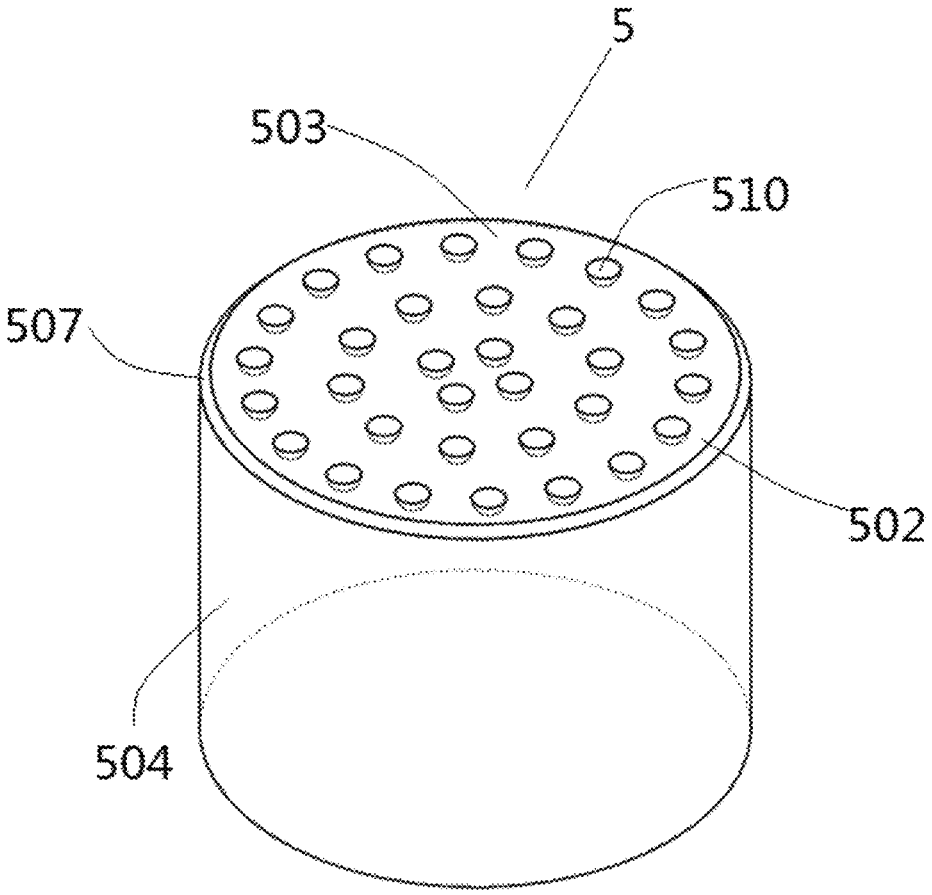
FIG. 3 is a perspective view of a cutting element in accordance with an embodiment disclosed herein.

FIG. 3 illustrates a cutting element 5 according to an embodiment of the invention. The cutting element 5 is substantially the form of a cylinder. It includes a table 502 bond to a substrate 504. The process for making a cutting element 5 may employ a body of cemented tungsten carbide as the substrate 504 where the tungsten carbide particles are cemented together with cobalt. The carbide body is placed adjacent to a layer of ultra-hard material particles such as diamond or cubic boron nitride particles and the combination is subjected to high temperature at a pressure where the ultra-hard material particles are thermodynamically stable. This results in recrystallization and formation of a polycrystalline ultra-hard material layer (the table 502), such as a polycrystalline diamond or polycrystalline cubic boron nitride layer, directly onto the upper surface of the cemented tungsten carbide substrate 504. The table 502 has a working surface 503 and at least one lateral surface 505, and a chamfer 507 formed therebetween. The angle between the side wall of the substrate 504 and the chamfer is about 45 degrees. In an embodiment, the angle is between 30 and 60 degrees. At least a portion of the chamfer 507 may also function as a working surface.

In order to reduce contact friction between the cuttings and the tool surface, the cutting element 5 is provided with a plurality dimples 510 on the working surface 503. These dimples 510 aid in chipping away the material being cut by cutting element 5, in providing breaking of chips in rock removal, and in moving small particles away from the drilling process and away from the working surface to reduce friction between the cuttings and the working surface 503. The generation of heat on the working surface 503 is decreased and thermal damage to the table 502 is reduced. This results in improved cutting element service life. The dimples 510 in FIG. 3 are hemispherical and distribute uniformly on the working surface 503. The radius of the dimple can vary.

Figure 4:
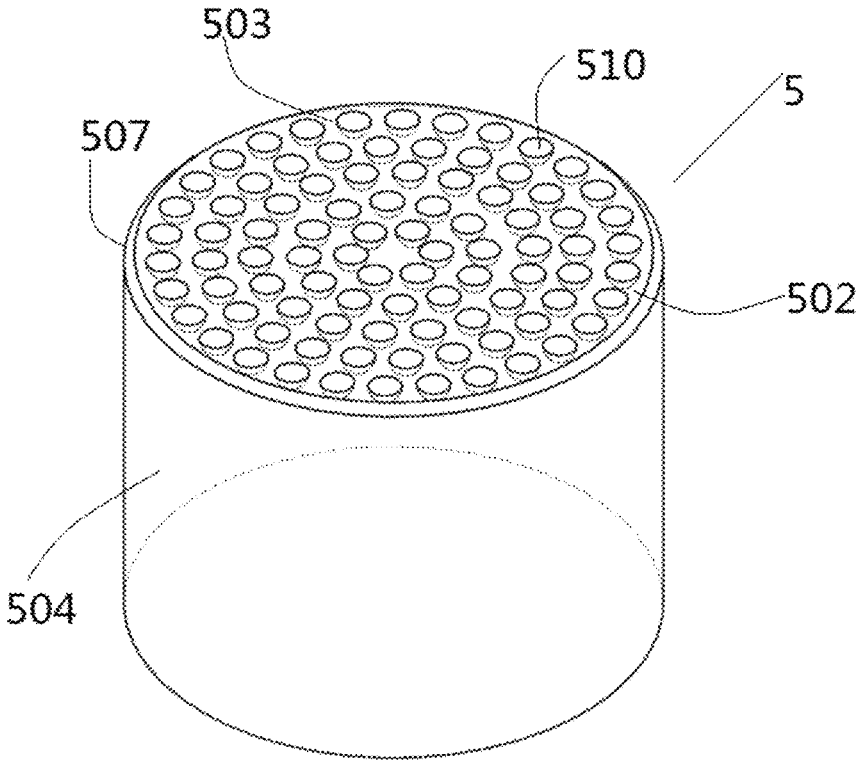
FIG. 4 is a perspective view of a cutting element with dimples on the working surface distributing more densely than on the working surface in FIG. 3.
Figure 5:
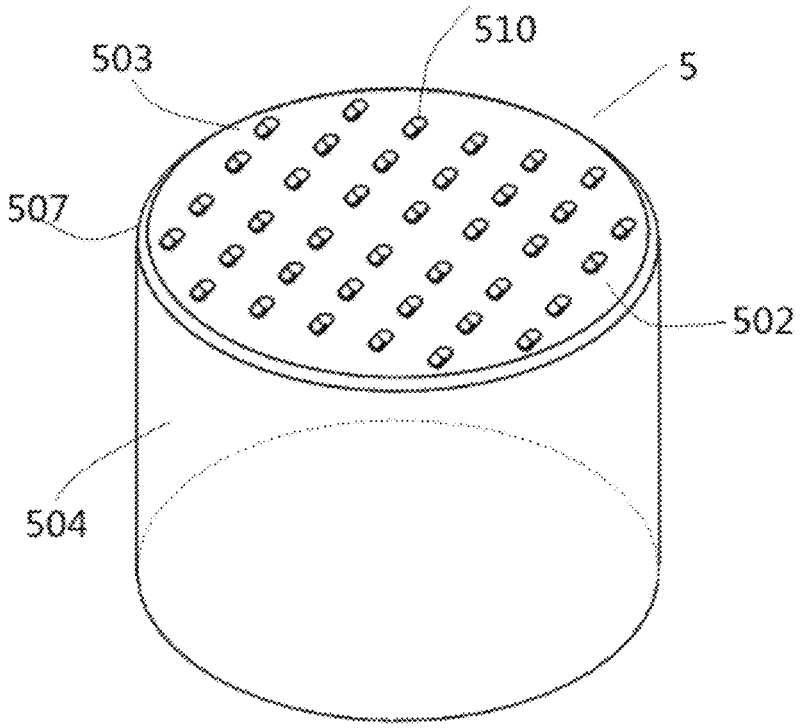
FIG. 5 is a perspective view of a cutting element with dimples with an elliptical shape.
Figure 6:
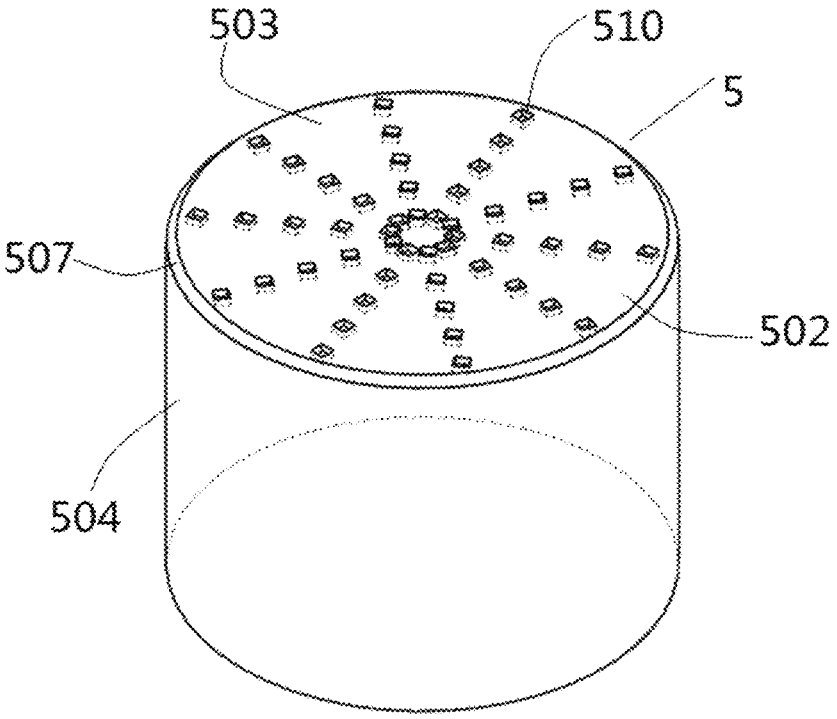
FIG. 6 is a perspective view of a cutting element with dimples with a square/rectangle shape.

It is to be understood that the design of the dimples 510 shown in FIG. 3 are for illustrative purposes only, and any of a variety of shapes, sizes, patterns of dimples on the working surface 503 can be formed, as desired. For example, FIG. 4 shows that the dimples 510 on the working surface 503 are distributed more densely than on the working surface 503 in FIG. 3. FIG. 5 shows that the shape of the dimples 510 are elliptical. FIG. 6 shows that the shape of the dimples 510 are square or rectangle. The distribution of the dimples 510 can be regular or be random. The dimples 510 can be distributed evenly throughout the working surface 503 as shown in FIG. 4 or distributed in a radial manner as shown in FIG. 6.

Figure 7:
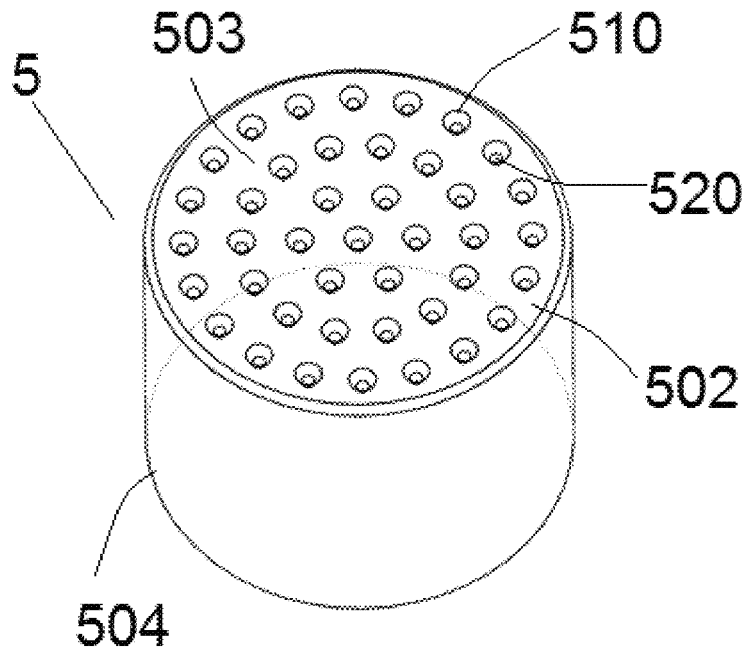
FIG. 7 is a perspective view of a cutting element with dimples having small dimples.

As will be recognized by those skilled in the art, there are other cutting element designs in accordance with the features of this invention. In a preferred embodiment, referring to FIG. 7, a cutting element having dimples surface is illustrated, the cutting element 5 has a substrate 504 and an ultra-hard layer 502 disposed thereon. A chamfer extends from the periphery of surface 503 to the side wall of the ultra-hard layer 502. The top surface 503 of the ultra-hard layer 502 has a plurality of dimples 510 having a first size, at least one tiny dimple 520 having a second size is located on the surface of at least one of the dimples 510, the second size is smaller than the first size. The tiny dimple 520 can reduce contact friction further between the cuttings and the tool surface further. Although only one tiny dimple 520 is shown at the bottom of the dimple 510, those skilled in the art will appreciate that a dimple 510 can have plurality of tiny dimples 520 located at any place of the surface thereon.

Figure 8:
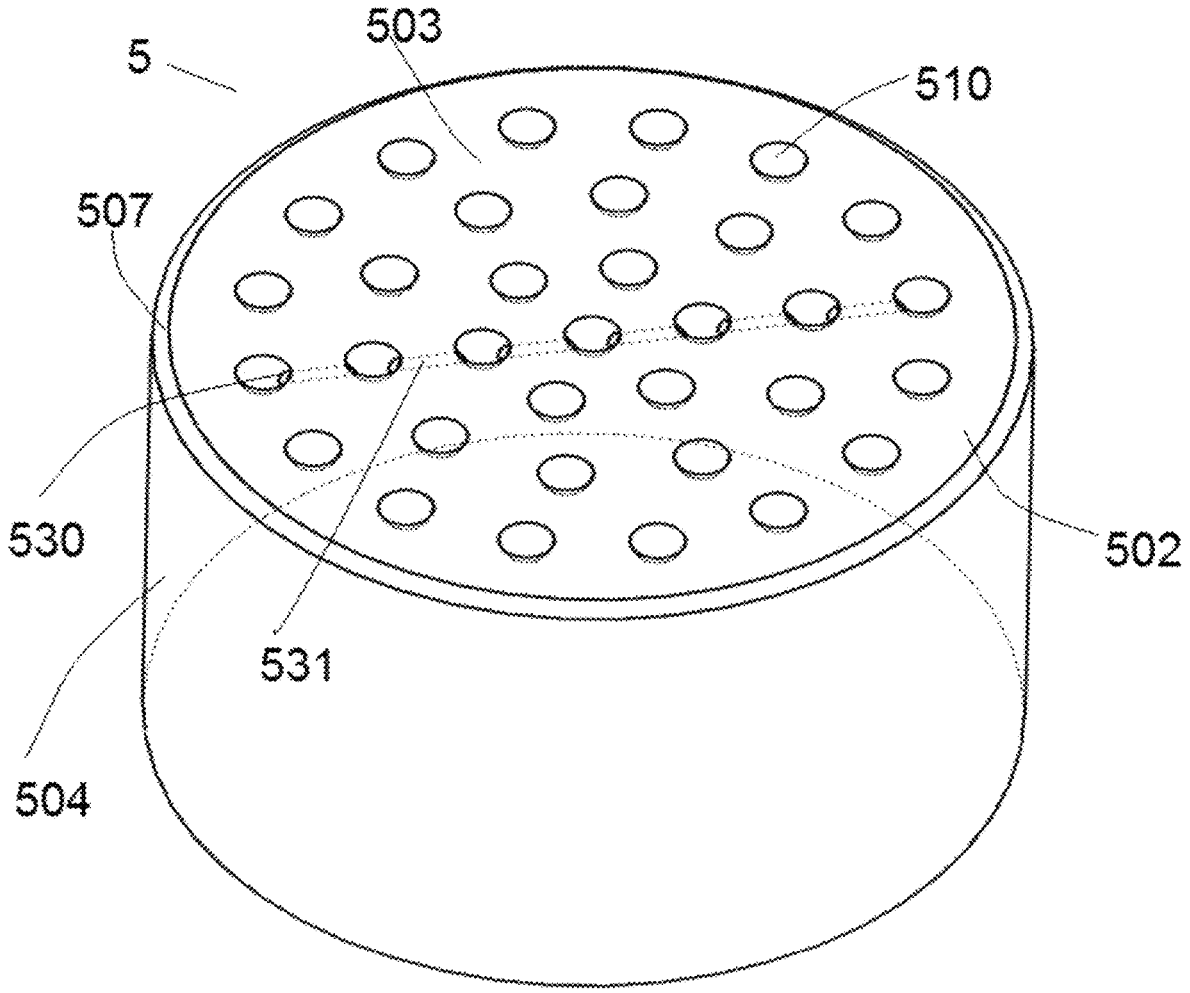
FIG. 8 is a perspective view of a cutting element with inter connecting dimples.

In another preferred embodiment, referring to FIG. 8, a cutting element having dimples surface is illustrated. The cutting element 5 has a substrate 504 and an ultra-hard layer 502 disposed thereon. A chamfer 507 extends from the periphery of surface 503 to the side wall of the ultra-hard layer 502. The top surface 503 of the ultra-hard layer 502 has a plurality of dimples 510. A plurality of channels 531 in the ultra-hard layer 502 inter-connect adjacent dimples with each other, at least one open 530 of channels 531 in a dimple 510 is shown in FIG. 8. Although only one open is shown at the surface of the dimple 510, those skilled in the art will appreciate that a dimple 510 can have plurality of opens with corresponding channels to connect with adjacent dimples. Drilling fluid can flow in the channels 531 and cool the ultra-hard layer 502 to improve cutting element cooling.

Figure 9:
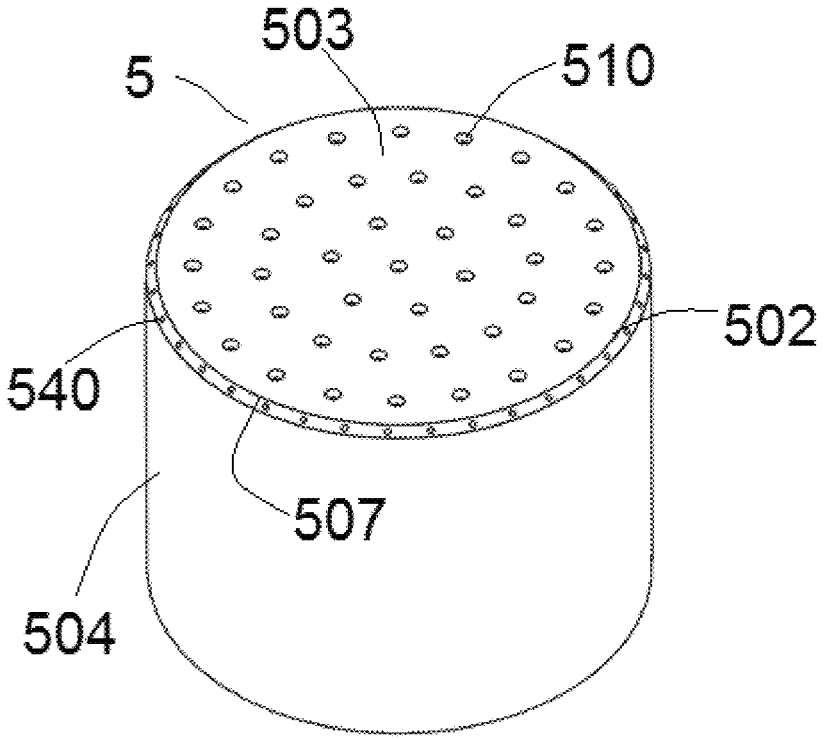
FIG. 9 is a perspective view of a cutting element with dimples on the chamfer surface.

In another preferred embodiment, referring to FIG. 9, a cutting element 5 having dimples surfaces is illustrated. The cutting element 5 has a substrate 504 and an ultra-hard layer 502 disposed thereon. A chamfer 507 extends from the periphery of surface 503 to the side wall of the ultra-hard layer 502. The top surface 503 of the ultra-hard layer 502 has a plurality of dimples 510. A plurality of dimples 540 are located on the chamfer 507 in the ultra-hard layer 502. They serve similar functionality as the dimples 510 on the top surface 503. In some embodiments, the size of the dimples 540 is smaller than the size of the dimples 510.

Figure 10:
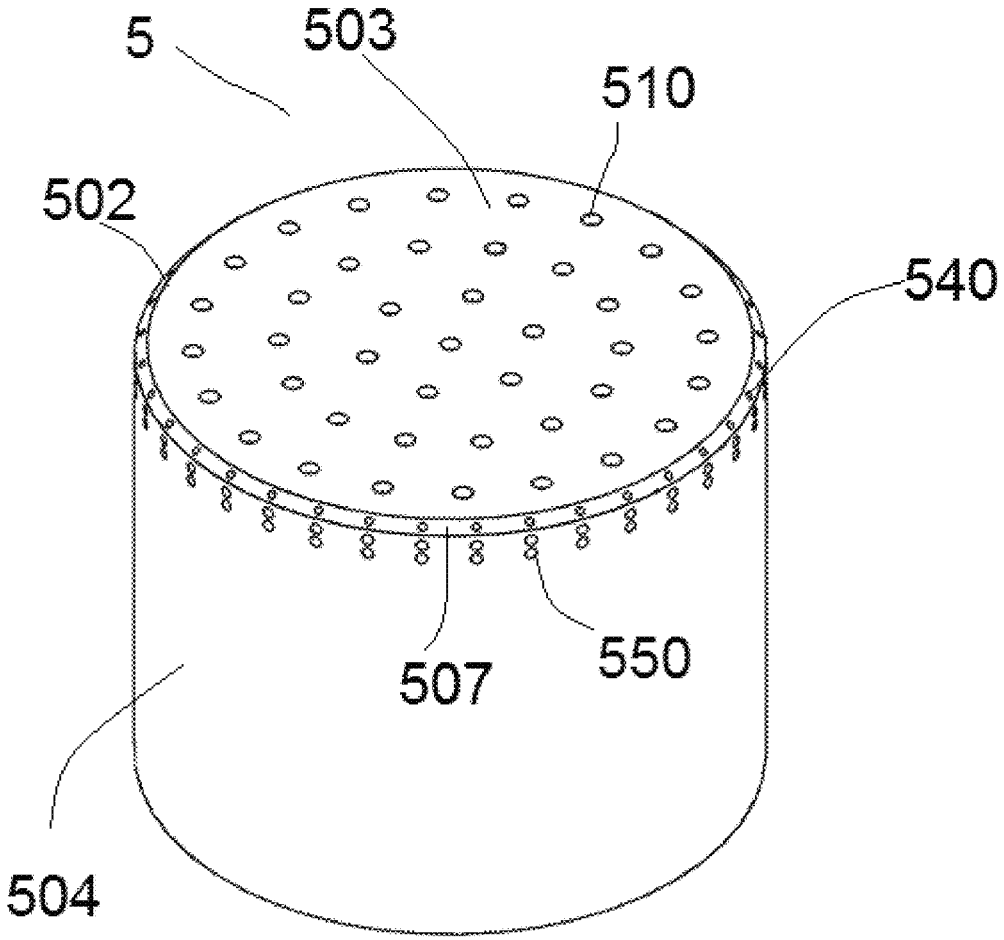
FIG. 10 is a perspective view of a cutting element with dimples on the cylindrical surface.

In another preferred embodiment, referring to FIG. 10, a cutting element having dimples surfaces is illustrated. The cutting element 5 has a substrate 504 and an ultra-hard layer 502 disposed thereon. A chamfer 507 extends from the periphery of surface 503 to the side wall of the ultra-hard layer 502. The top surface 503 of the ultra-hard layer 502 has a plurality of dimples 510, the dimples 540 are provided on the chamfer 507 in the ultra-hard layer 502. A plurality of dimples 550 are located on the cylindrical surface of the ultra-hard layer 502. They serve similar functionality as the dimples 510 on the top surface 503.

Figure 11:
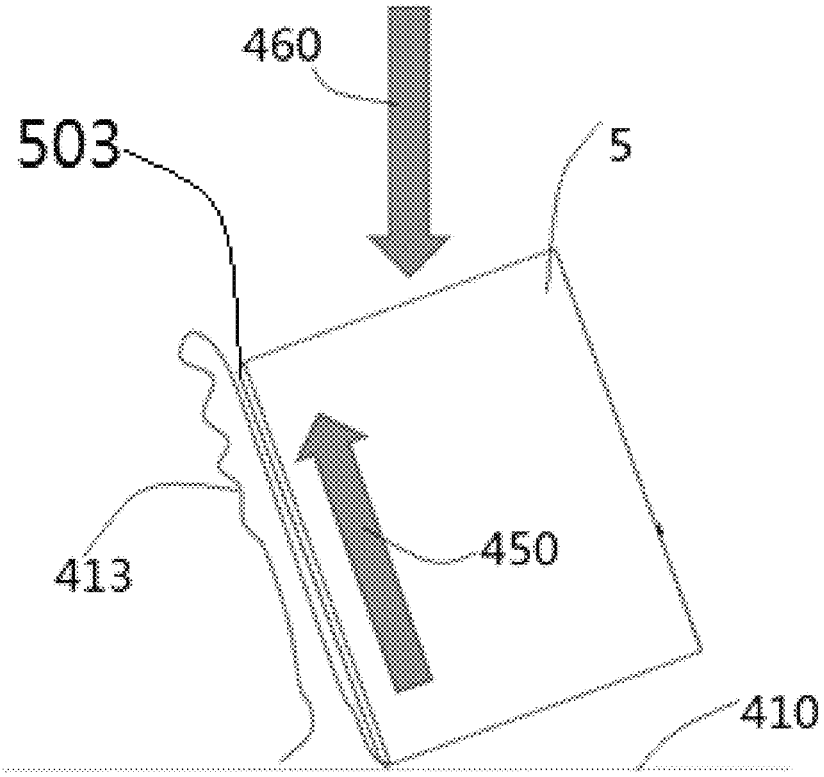
FIG. 11 is an illustration showing debris cut by the cutting element.

Referring to FIG. 11, the cutting element 5 cuts the formation 410 with working surface 503 to form a strip of debris 413. Surface patterns can reduce contact friction between the rock and the cutting element 5. Heat on the table 502 can thus be reduced, and thermal damage to the table 502 is decreased, eventually resulting in improved cutting element service life. And further, reduced friction means a smaller lifting force 450 and in turn a smaller hold down force 460 to balance the lifting force 450. That means there is a reduced overall weight on the bit to maintain the same amount of depth of cut, less heat is generated, and there is a more efficient rock removal process.

Figure 12:
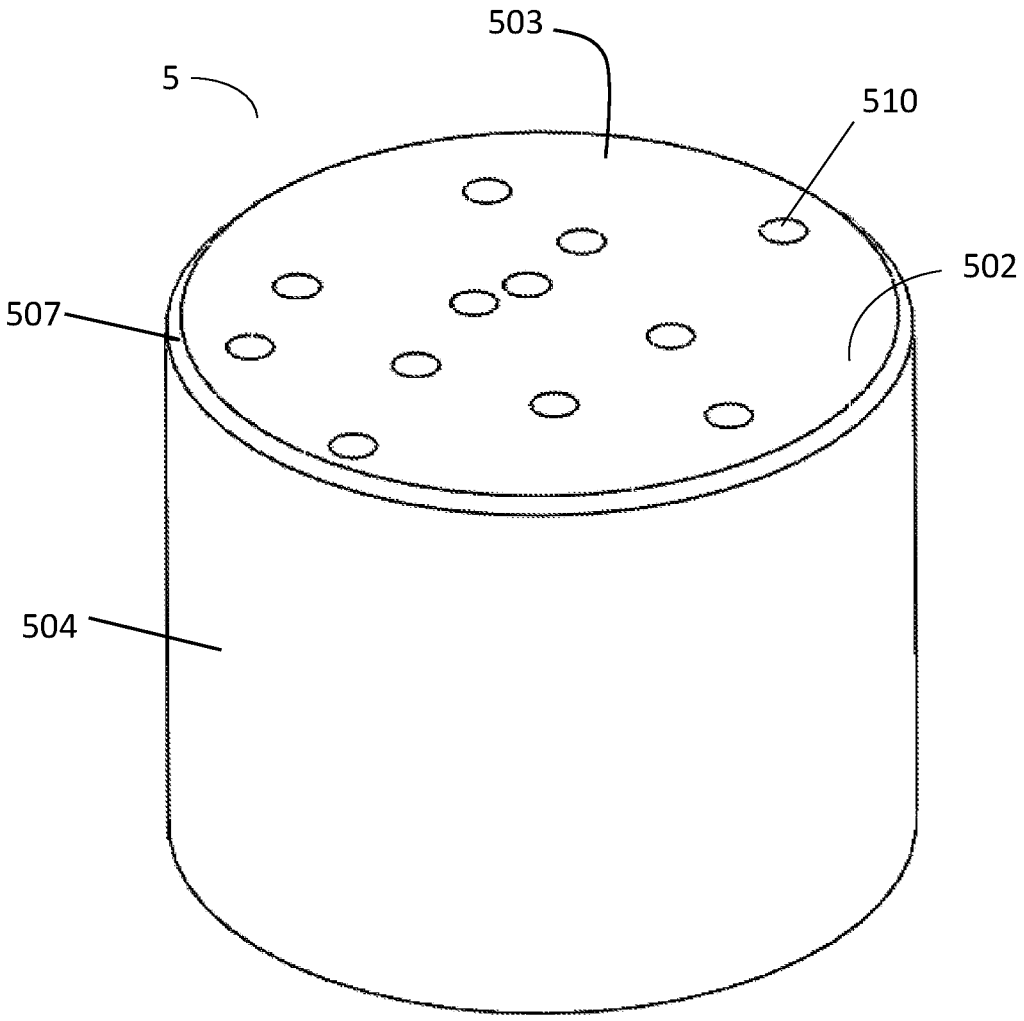
FIG. 12 is a perspective view of a random distribution of the plurality of dimples on the working surface.

In another preferred embodiment, referring to FIG. 12, a cutting element having dimples is illustrated. The cutting element 5 has a substrate 504 and an ultra-hard layer 502 disposed thereon. A chamfer 507 extends from the periphery of surface 503 to the side wall of the ultra-hard layer 502. The top surface 503 of the ultra-hard layer 502 has a plurality of dimples 510 wherein the distribution of the plurality of dimples 510 on the working surface is random.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A cutting element comprising:

a cylindrical substrate;

a table bonded to the substrate;

a planar working surface on the top of the table;

a plurality of dimples on the working surface; and at least one sub-working surface channel inter-connecting one or more dimples of the plurality of dimples, wherein a drilling fluid flows in the at least one channel.

2. The cutting element of claim 1, wherein the working surface is non-planar except for the plurality of dimples.

3. The cutting element of claim 1, wherein a shape of the plurality of dimples is hemispherical.

4. The cutting element of claim 1, wherein a shape of the plurality of dimples is elliptical.

5. The cutting element of claim 1, wherein a shape of the plurality of dimples is square or rectangular.

6. The cutting element of claim 1, wherein distribution of the plurality of dimples on the working surface is regular.

7. The cutting element of claim 1, wherein distribution of the plurality of dimples on the working surface is random.

8. The cutting element of claim 1, wherein the plurality of dimples is distributed evenly throughout the working surface.

9. The cutting element of claim 1, wherein the plurality of dimples is distributed in a radial manner throughout the working surface.

10. The cutting element of claim 1, further comprising a lateral surface and a chamfer formed between the lateral surface and the working surface.

11. The cutting element of claim 10, further comprising dimples on the chamfer.

12. The cutting element of claim 10, further comprising dimples on the lateral surface of the table.

13. The cutting element of claim 10, wherein an angle between the lateral surface and the chamfer is between 30 and 60 degrees.

14. The cutting element of claim 1, wherein the table is made of a super-abrasive material.

15. The cutting element of claim 14, wherein the super-abrasive material is polycrystalline diamond.

16. The cutting element of claim 1, further comprising at least one tiny dimple on the surface of at least one of the plurality of dimples, wherein the at least one tiny dimple is smaller than the at least one of the plurality of dimples.

* * * * *